US006023797A

United States Patent [19]

Brumfield

[11] Patent Number: 6,023,797

[45] **Date of Patent: *Feb. 15, 2000**

[54] COMFORT BEACH TOWEL WITH INFLATABLE PILLOW

[76] Inventor: John David Brumfield, 351 Walnut St., Charleston, W. Va. 25523-1405

[ * ] Notice: This patent is subject to a terminal disclaimer.

[21] Appl. No.: 09/158,281

[22] Filed: Sep. 22, 1998

Related U.S. Application Data

[63] Continuation-in-part of application No. 09/008,058, Jan. 16, 1998, Pat. No. 5,850,643, which is a continuation-in-part of application No. 08/831,053, Apr. 1, 1997, abandoned.

[51] Int. Cl.[7] ..... A47G 9/06; A47G 9/00

[52] U.S. Cl. ..... 5/419; 5/485; 383/4

[58] Field of Search ..... 5/485, 500, 502, 5/419, 417, 644, 420; 383/4

[56] References Cited

U.S. PATENT DOCUMENTS

| | | | |
|---|---|---|---|
| 4,097,944 | 7/1978 | Yulish | 5/419 |
| 4,116,702 | 9/1978 | Rohrnger et al. | 106/190 |
| 4,222,926 | 9/1980 | Mizuno et al. | 260/40 R |
| 4,624,320 | 11/1986 | Romaine | 169/50 |
| 4,634,618 | 1/1987 | Greer et al. | 428/81 |
| 5,172,440 | 12/1992 | Ming | 5/485 |
| 5,346,308 | 9/1994 | Buhot et al. | 383/4 |
| 5,454,125 | 10/1995 | Ratkowski | 5/419 |
| 5,457,829 | 10/1995 | Elliott | 5/490 |
| 5,629,071 | 5/1997 | Feldman | 5/419 |
| 5,638,561 | 6/1997 | Sperry et al. | 5/485 |

*Primary Examiner*—Alexander Grosz
*Attorney, Agent, or Firm*—Robert N. Blackman

[57] ABSTRACT

A comfort system is provided involving a towel, blanket or cloth that folds into a pillow configuration, and in a fire retardant version is useful as vehicle comfort system. The comfort system involves a length of cloth or fabric that folds into a pillow configuration. An air bladder contained within the pillow supplements the pillow to provide increased comfort. The comfort system provides reduced weight and convenient storage volume consumption for aircraft while providing the flexibility of selectively functioning as a pillow or towel or cover according to the particular needs of the user.

15 Claims, 2 Drawing Sheets

COMFORT BEACH TOWEL WITH INFLATABLE PILLOW

This is a continuation in part application of Brumfield Ser. No. 09/008,058, filed Jan. 16, 1998. Now U.S. Pat. No. 5,850,643, which is a continuation-in-part of Ser. No. 08/831,053, filed Apr. 1, 1997, now abandoned.

BACKGROUND OF THE INVENTION

1. Field of the Invention

The present invention relates to comfort systems, and more particularly relates to comfort systems having blankets, towels or quilts.

2. Description of the Related Art

Conventional aircraft comfort systems employ a plurality of blankets and a plurality of pillows. Flyers seeking comfort can access the pillows and/or blanket that they desire from the overhead storage compartment. During some flights there may be a demand for a large number of pillows and on other flights there may be large demand for blankets. In order to meet this demand, there are typically an excess of either blankets and/or pillows on any flight because the exact demand of that flight is not known at the time of takeoff. This excess of pillows and/or blankets typically means that these comfort systems typically utilize more than desired levels of overhead storage space and any weight added by these systems is undesired due to the additional fuel required to transport them.

Beach towels are known that are made of cotton, terry cloth, polyester, or other natural and man-made fabrics. Towels typically are rectangular in shape and are elongated in one direction to allow the user to lay the towel on the sand, chaise lounge, or pool side surface to provide a barrier between the user and the environment. One central deficiency of these beach towels is that they provide little to no comfort and act merely as a barrier to dirt and sand. In addition, the towels are bulky and awkward to carry about, especially when toted in addition to chairs, coolers, and sundry beach toys.

Consequently, there is a need and desire to provide comfort systems for aircraft, boats, beaches and other seating areas which require reduced storage space and reduced weight compared to conventional comfort systems.

SUMMARY OF THE INVENTION

The present invention involves a comfort system involving a towel, spread, cover, or table cloth, etc., that folds into a pillow configuration. The comfort system of the present invention provides reduced weight and reduced storage volume consumption and portable configuration for general use while providing the flexibility of selectively functioning as a pillow or blanket according to the particular needs of the user.

DETAILED DESCRIPTION OF THE INVENTION

Figure 1:
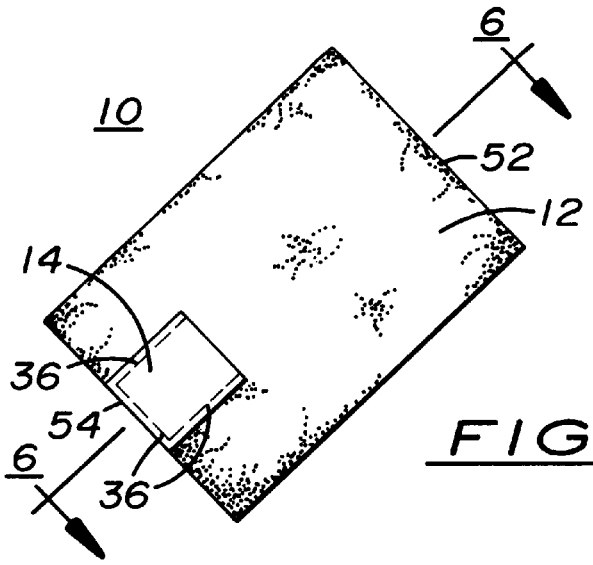
FIG. 1 is a perspective view of the comfort system of the present invention in an unfolded position to function as a towel.
Figure 5:
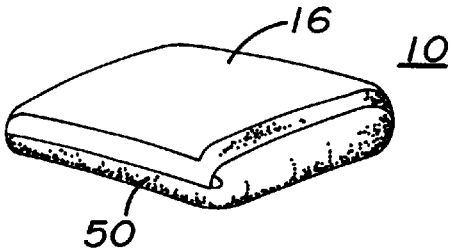
FIG. 5 is a perspective view of the comfort system in a completely folded position to function as a pillow.

As shown in FIG. 1, a comfort system (10) comprises (a) a cloth, material, or fabric such as a towel, cover, picnic cloth, mat, quilt or blanket ("towel" or "blanket") (12) and (b) a pocket (14), and preferably, as shown in FIG. 5, the pocket has indicia (16) thereon. The towel may be fabricated from cotton, cotton blend, terry cloth, polyester, paper, plastic, or any other man-made or natural fiber or material depending on the required need of the user. The towel (10) may also be made of a flame resistant and/or fire retardant material suitable for use in various environments including aircraft, boats, or other vehicles (18).

The towel (12) preferably is a soft foldable material sufficient to provide a user (20) with comfort during use. The towel (12) may be the size of conventional beach towel, for example from 48 to 60 inches in width and from 60 to 72 inches in length. The towel (12) may be made of a suitable flame/fire resistant material such as is commercially available from FAB Industries, Inc. Various fire resistant, flame retardant polyester fibers and polyester blankets are known, see for example Mizuno et al U.S. Pat. No. 4,222,926 issued Sep. 16, 1980, Romaine U.S. Pat. No. 4,624,320 issued Nov. 25, 1986, and Rohringer et al U.S. Pat. No. 4,116,702 all of which are incorporated herein by reference.

The pocket (14) is preferably made by attaching a cloth panel (22) to a central end portion (24) of the towel (12). The panel (22) is preferably rectangular in shape and is attached (such as by stitching (36)) to the towel (12) along three sides (26, 28, 30) of the panel (22), and is unattached at the remaining side (32) such that the pocket is open toward the center of the towel when the comfort system (10) is in its unfolded position as shown in FIG. 1. The position of the pocket and the position of the open end of the panel allows the user (20) to place the user's feet (not shown) within the pocket (14) while the remainder of the towel (12) is used by the user (20) to cover the upper portion of the user's body. The pocket (14) position and orientation also permit the towel (12) to be easily and consistently folded into an effective pillow shape as shown in FIG. 5.

Figure 2:
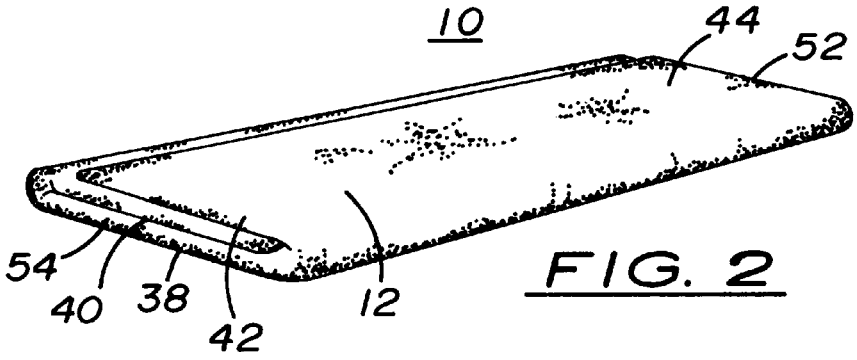
FIG. 2 is a perspective view of the comfort system in a partially folded position.
Figure 4:
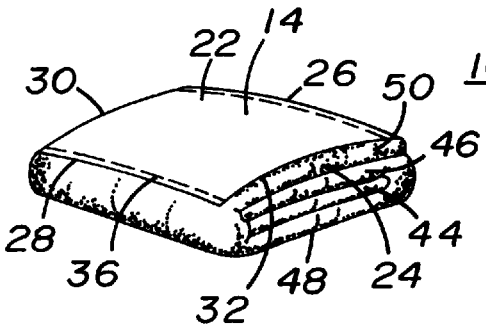
FIG. 4 is a perspective view of the comfort system in a third partially folded position.

The comfort system (10) may be converted from an unfolded towel configuration as shown in FIG. 1 to a folded pillow configuration as shown in FIG. 5 by the steps of (a) positioning the towel (12) flat with the pocket on the underside of the towel 12, (b) folding the towel lengthwise into three substantially equal segments (portions) (38, 40, 42) with side portions (40, 42) being folded over middle portion (38) to create a three layer partially folded (elongated, narrow) configuration as best shown in FIG. 2; (c) folding (three folds, four substantially equal sized sections (44, 46, 48, 50)) the (narrow) partially folded configuration from an end (52) opposite the pocket (14) to an end (54) adjacent the pocket (14) (as shown in FIG. 4); and (d) turning (inverting, pulling) the pocket (14) over the sections (44, 46, 48, 50) to produce the desired pillow configuration as best shown in FIG. 5.

Figure 3:
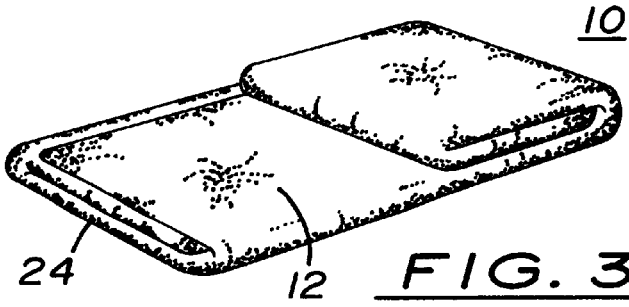
FIG. 3 is a perspective view of the comfort system in a second partially folded position.

The turning step results in the inside of the pocket (14) being turned to an exterior orientation (position) so that desired indicia (16) (such as advertising) is exposed to the user. This feature is especially attractive to the retailers where marketing and advertising may increase the sales or revenues therefrom or to promote the services of the retailer or to provide industry specific advertising for sports teams or clothing manufacturers. The structural relationship between the indicia and the pocket permits its selective exposure upon use of the comfort system so that during use at the users home the advertising is not distractive (inconsistent with the home atmosphere), but during storage the advertising is prominently displayed. FIG. 5 shows the comfort system folded into its pocket to form a pillow with the advertising indicia exposed. FIG. 3 shows the towel in a partially folded position having had the lengthwise folds made and two of the three widthwise folds made. FIG. 4 shows the towel with the two lengthwise folds having been made followed by the three widthwise folds having been made.

Figure 6:
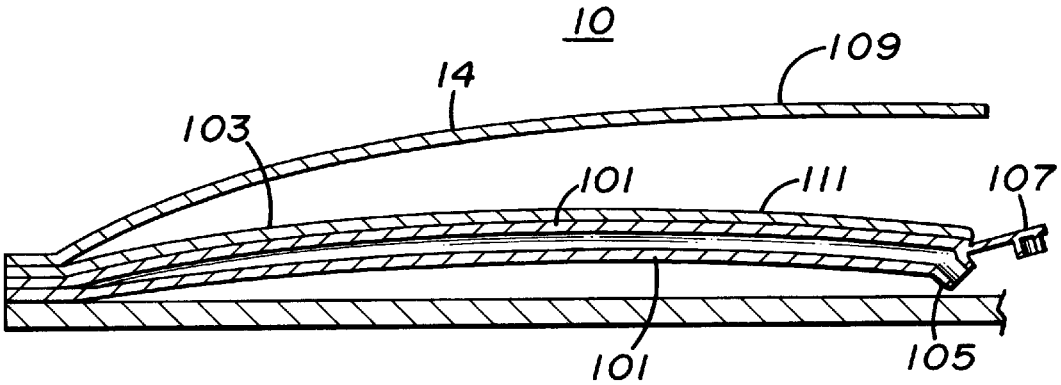
FIG. 6 is a vertical cross-sectional cutaway view of a comfort system having an inflatable pillow element in a pocket.

As best shown in FIG. 6, the comfort system 10 has an inflatable pillow element 101 positioned within (hidden in) the pocket 14 for permitting the user to inflate the pillow element 101 when the comfort system is unfolded. The pocket 14 comprises an inner pocket 103 in which the pillow element 101 is positioned. The inner pocket 103 serves to permit the pillow element 101 to be hidden from view and to be covered by soft cloth type material (fabric) when the comfort system is in either its folded or unfolded position. The pillow element is preferably made of an air impermeable (inflatable) plastic material such as that used in inflatable plastic items such as air mattresses. The pillow element has an air tube 105 for permitting atmospheric air to be forced into the inflatable element 101 by conventional means such as a pump or by lung pressure. Air tube 105 has a cap 107 which allows the user to seal the pillow inflatable element 101 after inflation by threading the cap onto the air tube 107 to shut off air communication between the inflatable element 101 internal cavity and the atmosphere. Removal of the cap 107 allows the user to bring the inflatable element 101 internal cavity into communication with the atmosphere to deflate the pillow element for easier storage. The unique dual pocket arrangement provides for adequate pocket space for folding of the towel into its folded position without the visually undesirable exposure of the pillow element. The pillow element is preferably rectangular (square) in shape and substantially the size of the pocket 14. The pillow element may be secured to the pockets by stitching a perimeter (plastic lip) of the element to the adjacent fabric of the pockets.

A comfort system comprises (a) a towel, (b) a pocket attached to the towel, the pocket being positioned adjacent an end of the towel and being open toward the center of the towel when the towel is in an open position. The pocket comprises an outer pocket layer 109 and an inner pocket layer 111. The system further comprises an inflatable pillow element secured to the inner pocket layer between the inner pocket layer and the towel.

One skilled in the art would appreciate that the concept of a length of fabric or cloth, either in the form of a towel, blanket, quilt, picnic blanket, baby mat or other such device, could benefit from the central premise of a comfort fabric which is foldable into a central pocket and contains an inflatable bladder within the pocket to augment the pillow or act as the pillow when the towel or blanket is deployed.

It is to be understood that the present invention is not limited to the sole embodiment described above, but encompasses any and all embodiments within the scope of the following claims.

what is claimed is:

1. A comfort system comprising:

(a) a predetermined length of cloth material, (b) a pocket attached to said cloth, said pocket being positioned adjacent an end of said cloth and being open toward the center of said cloth when said cloth is an open position, said pocket comprising an outer pocket layer and an inner pocket layer, and (c) an inflatable pillow element secured to said inner pocket layer between said inner pocket layer and said cloth, said cloth adapted to be folded and stored in said pocket.

2. The comfort system of claim 1, wherein said cloth is a beach towel.

3. The comfort system of claim 1, wherein said cloth is a blanket.

4. The system of claim 1 wherein said pocket has a width of one third of the width of the cloth.

5. The system of claim 2 wherein said pocket has a length of one fourth of the length of the cloth.

6. The system of claim 1 wherein said pocket has indicia on the interior thereof.

7. The system of claim 1 wherein said comfort system comprised a fire resistant material.

8. The system of claim 7 wherein said material is a polyester fibrous material.

9. The system of claim 1 wherein said material is a man-made fiber.

10. The system of claim 1 wherein said material is a natural fiber.

11. A method for converting a comfort system having a pillow element and a cloth towel into a pillow, said method comprising:

(a) providing a cloth towel with an outer pocket positioned adjacent one end of said towel and an inner pocket positioned within said outer pocket, said outer pocket having an opening, said inner pocket having an inflated pillow element positioned therein, (b) deflating said pillow element, (c) folding said towel into sections, said sections being sufficiently small to be received by said outer pocket, and (d) turning said sections into said outer pocket by pulling said pocket over said sections to form the pillow having said pillow element covered by said a layer of said inner pocket.

12. The method of claim 11 wherein said pocket has indicia positioned so that the indicia is seen when said pillow is formed.

13. The system of claim 11 wherein said material is a man-made fiber.

14. The system of claim 11 wherein said material is a natural fiber.

15. The method of claim 11 wherein said pocket has a size of one twelfth the size of the towel based on the area of the towel, said method comprising folding the towel lengthwise with two folds and then folding the towel widthwise with three folds.

* * * * *